United States Patent [19]

Krone et al.

[11] 4,376,001

[45] Mar. 8, 1983

[54] SMOKE COMPOSITION

[75] Inventors: Uwe Krone, Hamfelde; Klaus Moeller, Trittau, both of Fed. Rep. of Germany

[73] Assignee: Nico-Pyrotechnik Hanns-Juergen Diederichs KG., Trittau, Fed. Rep. of Germany

[21] Appl. No.: 175,710

[22] Filed: Aug. 6, 1980

Related U.S. Application Data

[63] Continuation-in-part of Ser. No. 942,684, Sep. 15, 1978, abandoned.

[30] Foreign Application Priority Data

Sep. 27, 1977 [DE] Fed. Rep. of Germany ..... 2743363

[51] Int. Cl.[3] ..... C06B 45/10

[52] U.S. Cl. ..... 149/19.9; 149/76; 149/117

[58] Field of Search ..... 149/19.9, 76, 84, 85, 149/117

[56] References Cited

U.S. PATENT DOCUMENTS 3,625,855 12/1971 Douda ..... 149/19.91

3,724,382 4/1973 Zilcosky ..... 149/84

OTHER PUBLICATIONS

Hawley, *The Condensed Chemical Dictionary,* 9th Ed., p. 758, Van Nostrand Reinhold Co. (1977), N.Y.

*Primary Examiner*—Edward A. Miller

[57] ABSTRACT

A smoke generating composition consisting essentially of metallic oxide ammonium perchlorate, an organic chlorine donor and a plasticizer and a buffering agent. The metallic oxide includes zinc oxide as one of its components and ammonium perchlorate as well as polychloroisoprene as components of the chlorine donor. All of the components are mixed in such proportions that a neutral fog within the range of pH 5–7 is formed.

4 Claims, No Drawings

SMOKE COMPOSITION

CROSS-REFERENCE TO RELATED APPLICATION

This is a continuation-in-part of our copending application Ser. No. 942,684, filed on Sept. 15, 1978 and now abandoned.

BACKGROUND OF THE INVENTION

This invention relates to a smoke generating composition which essentially consists of a metallic oxide, ammonium perchlorate, an organic chlorine donor and a plasticizer and a buffering agent.

There is already known in the state of the art a smoke generating or fog generating composition which is essentially produced from metallic oxide, ammonium perchlorate and an organic chlorine donor (see for example U.S. Pat. No. 3,724,382). This type of smoke composition yields a dense, surface-adhering fog, having good camouflage properties. However, the produced smoke or fog composition has the serious drawback of being strongly acidic. In addition to the physiological harmful action caused by this known fog or smoke composition, the corrosive effect caused by the acid contained therein must also be considered. This corrosive effect may cause damage to the installations and defense equipment of the combat unit that is producing the camouflage smoke or fog. In addition thereto, these known smoke or fog compositions, due to their sensitivity to atmospheric moisture, have only a limited storage life. Therefore, these known smoke or fog generating compositions have a short useful life. Moreover, the additional risk exists that the smoke generating composition may spontaneously ignite due to absorbtion to atmospheric moisture.

Attempts have been made to remove or mitigate the aforedescribed drawback in smoke generating compositions. For example, the limited storage life of such smoke generating compositions has been improved by the addition of a storage-stable HC (hexochlorethane). Such a smoke generating composition is disclosed in German published application No. 24 51 701.

SUMMARY OF THE INVENTION

It is the general object of this invention to provide a smoke generating composition in which the aforedescribed drawbacks have been eliminated or at least mitigated.

It is another object of this invention to provide a smoke generating composition which effects a dense and good surface adhering smoke or fog and has extraordinary camouflage properties while at the same time being sufficiently neutral so as not to have adverse physiological effects.

It is a further object of this invention to provide a storage-stable smoke generating composition which is as free as possible of metal powder.

DETAILED DESCRIPTION

According to the invention, a smoke generating composition is provided which contains zinc oxide as a metallic oxide and ammonium perchlorate as well as polychloroisoprene as organic chlorine donors. The smoke generating composition of this invention further includes a plasticizer and a buffering agent. All the components are mixed in such a proportion to one another that a neutral fog within the range of pH 5–7 is formed.

A plasticizer is added to the composition in accordance with this invention as follows: dioctyl phthalate (DOP) or dioctyl sebacate (DOS) or dioctyl adipate (DOA) or dioctyl terephthalate (DOTP).

Finally, ammonium chloride can be added to the components for buffering the fog and it also serves as combustion moderator at the same time.

The process for producing the smoke generating composition in accordance with this invention consists in that the dry components are wetted with the plasticizer and are homogenously mixed with each other while ammonium chloride is added to the mixture until a pasty composition is formed. This composition is pressed into a mold and hardened for two hours at 80° C., following which the solidified smoke generating composition is removed from the molds and is immersed in a bath where it is sprayed or lackered with a protective coating.

In this manner the hardened smoke generating composition first receives a coating of a plasticizer-resistant methacrylic resin for stabilizing its surface and thereafter a coating of synthetic rubber for stabilizing the smoke generating composition against harmful external influences.

Examples of smoke generating compositions having the features and properties described hereinabove in accordance with the invention are set forth in tabular form hereinbelow. All percentages are wt. %.

EXAMPLE I

A smoke composition for screening is as follows 34.0% ammoniumperchlorate
31.3% zinc oxide
15.0% polychloroisoprene
10.3% ammoniumchloride
9.4% di-octyl-phthalate by varying the content of the ammoniumperchlorate and ammoniumchloride the rate of combustion of the smoke composition can be adjusted to a great extent which also brings about a change in the pH of the produced smoke as is illustrated by the following examples.

| | EXAMPLES | | | |
|---|---|---|---|---|
| | II | III | IV | V |
| (a) ammonium-perchlorate | 34.0% | 30.0% | 40.5% | 31.3% |
| (b) ammoniumchloride | 10.3% | 14.3% | 3.8% | 13.0% |
| (c) zinc oxide | 31.3% | 31.3% | 31.3% | 31.3% |
| (d) polychloroisoprene | 15.0% | 15.0% | 15.0% | 15.0% |
| (e) di-octyl-phthalate | 9.4% | 9.4% | 9.4% | 9.4% |
| burning velocity | 1 mm/s | 0.7 mm/s | 1.4 mm/s | 0.9 mm/s |
| pH value | 5.9 | 6.2 | 5.0 | 6.0 |

It can be noted that in the foregoing examples I–V components (c), (d) and (e) remain constant. For purposes of changing the mechanical properties for obtaining a hardened smoke composition, the components (c), (d), and (e) can only be varied to a small degree as follows:

(c) zinc oxide 29–33%
(d) polychloroisoprene 10–17%
(e) di-octyl-phthalate 6–12%

It has been established by extensive testing that smoke generating compositions in accordance with the invention can only be obtained by using the following component wt.% ranges for the composition:

31.3–40.4% amoniumperchlorate
29–33% zinc oxide
10–17% polychloroisoprene
3.8–14.3% buffering agent
6–12% plasticiser Suitable buffering agents, other than ammonium chloride, are, for example, ammonium acetate and alkylammonium salts.

The physical properties of the afore-mentioned polychloroisoprene are as follows:

chlorine content about 67%
decomposition point about 200° C.
ash content about 0.1%
molecular weight about 135.000

The manufacturer of the polychloroisoprene is Bayer AG of West Germany and it is marketed in West-Germany under the tradename PERGUT.

The plasticiser-resistant acrylic resins used to coat the smoke-generating composition of the invention are for example, ACRONAL 500 D, manufactures and marketed by BASF (Badische Anilin- und Sodafabriken) West-Germany.

The synthetic rubber used to coat the acrylic resin coating can, for example, be a commercially available water-resistant paint which is marketed in West-Germany under the tradename AMPHIBOLIN.

In this smoke generating composition there is primarily formed zinc chloride from ammonium perchlorate, zinc oxide and polychloroisoprene. Due to the simultaneous presence of ammonium chloride there are formed zinc chloride-ammine complexes which possess pH values of about 6.

This smoke generating composition, after being pressed and hardened yields a dense white fog or smoke. Tests have shown that the burning speed of a cylindrically shaped test body having a diameter of 20 mm and a height of 100 mm is above 1 mm per second. The afore-described smoke generating composition of this invention possesses a pH value of 5.6–6.2 and therefore falls into the quasi-neutral range.

Although the sensitivity to friction and impact of the smoke generating composition of the invention is quite low, it can, nevertheless be ignited by means of a match. Advantageously the site for igniting the smoke generating composition, which is provided with a double coating, can remain covered with a metallic or plastic adhesive foil until the smoke generating composition is ready to be used. Similarly, as the hardened smoke generating composition is removed from the mold and is covered with the coatings, it can in addition be covered with a permanent envelope made of tinplate material or the like and permitted to solidify in such an envelope.

As will be apparent to persons skilled in the art, various modifications, adaptations and variations of the foregoing specific disclosure can be made without departing from the teachings of the present invention.

We claim:

1. A smoke or fog generating composition consisting essentially of

29–33% wt. zinc oxide;
31.3–40.4% wt. ammoniumperchlorate
10–17% wt. polychloroisoprene;
3.8–14.3% wt. a buffering agent; and
6–12% wt. of a plasticizer all of the components being mixed in such proportion to one another that a neutral smoke or fog is formed by said composition upon its ignition within the range of pH 5–7.

2. The smoke or fog generating composition as set forth in claim 1, wherein said plasticizer is selected from the group of plasticizers consisting of dioctyl phthalate (DOP) or dioctyl sebacate (DOS) or dioctyl terephthalate (DOTP).

3. The smoke or fog generating composition as set forth in claim 1, wherein ammoniumchloride is said buffering agent for buffering the produced smoke or fog and for moderating the combustion of the smoke or fog generating composition.

4. A smoke or fog generating composition as set forth in claim 1, consisting essentially of 34 wt.% ammoniumperchlorate
31.3 wt% zinc oxide
15.0 wt.% polychloroisoprene
9.4 wt.% di-octyl-phthalate and
10.3 wt.% ammoniumchloride.

* * * * *